United States Patent [19]

Smith

[11] 4,056,057

[45] Nov. 1, 1977

[54] VACUUM PRINTING CYLINDER CONSTRUCTION

[75] Inventor: Earl R. Smith, Ashway, R.I.

[73] Assignee: Livermore and Knight Co., Inc., Palm Beach, Fla.

[21] Appl. No.: 661,841

[22] Filed: Feb. 27, 1976

[51] Int. Cl.[2] ..... B41F 27/12; B25B 11/00

[52] U.S. Cl. ..... 101/382 MV; 101/415.1; 269/21; 271/276

[58] Field of Search ..... 248/362, 363; 279/3; 269/21; 51/235; 101/382 MV, 407 BP, 409, 415.1; 271/275, 276

[56] References Cited

U.S. PATENT DOCUMENTS

| | | | |
|---|---|---|---|
| 873,340 | 12/1907 | Bagnall | 269/21 |
| 1,596,775 | 8/1926 | Stephansen | 162/368 |
| 1,945,481 | 1/1934 | Dilkes | 279/3 |
| 1,970,368 | 8/1934 | Fishburn | 51/235 |
| 2,060,082 | 11/1936 | Johnson et al. | 101/382 MV |
| 2,753,181 | 7/1956 | Anander | 269/21 X |
| 2,852,264 | 9/1958 | Granata | 279/3 |
| 3,052,479 | 9/1962 | La Trell | 279/3 |
| 3,071,812 | 1/1963 | Miller | 51/235 |
| 3,078,796 | 2/1963 | Kamata et al. | 101/378 |
| 3,112,698 | 12/1963 | Lake | 101/415.1 |
| 3,536,003 | 10/1970 | Oderman | 101/415.1 |
| 3,627,338 | 12/1971 | Thompson | 51/235 |
| 3,683,730 | 8/1972 | Driessen | 83/27 |
| 3,838,865 | 10/1974 | Roberts et al. | 51/235 X |

FOREIGN PATENT DOCUMENTS

| | | | |
|---|---|---|---|
| 2,354,418 | 5/1975 | Germany | 101/409 |
| 570,795 | 7/1945 | United Kingdom | 101/382 MV |
| 1,401,695 | 7/1975 | United Kingdom | 101/382 MV |

*Primary Examiner*—Russell R. Kinsey
*Assistant Examiner*—Paul J. Hirsch
*Attorney, Agent, or Firm*—Mandeville and Schweitzer

[57] ABSTRACT

An improved form of vacuum-operated printing cylinder for a printing press, providing a practical means for holding the printing plate on the cylinder by vacuum alone. The cylinder comprises a hollow supporting shaft forming a pre-evacuation chamber. A plurality of axially spaced support rings are secured to the shaft and support a hollow cylinder sleeve. The cylinder sleeve, support rings and shaft form a hollow printing cylinder structure having a plurality of vacuum chambers. Each of the vacuum chambers is provided with independently valved air passage means for communication between the chamber and the pre-evacuation chamber. The cylinder sleeve is provided with a plurality of appropriately distributed radial passages for vacuum communication between the vacuum chambers and the exterior surface of the printing cylinder. The pre-evacuation chamber is connected by piping to a vacuum source and kept evacuated. To particular advantage, the vacuum effect of the pre-evacuation chamber can be immediately applied to the cylinder surface, by opening the appropriate valves, to effect a preliminary gripping of the printing plate.

12 Claims, 5 Drawing Figures

VACUUM PRINTING CYLINDER CONSTRUCTION

BACKGROUND AND SUMMARY OF THE INVENTION

Rotary printing machines, such as rotary offset lithographic presses, for example, utilize printing cylinders to which printing plates are conformed and secured. The printing plates rotate with the cylinders and apply the desired impression to a rubber covered blanket cylinder, which then transfers the impression to a sheet or web passed between the blanket cylinder and an opposing roll or plate. Typically, means are provided on the printing cylinder for mechanically engaging one or both ends of the printing plate in order to keep the plate properly positioned on the cylinder. Commonly, this is done by providing means for clamping the ends of the printing plate. In some cases, adhesive is utilized, alone or in conjunction with other means, to hold the printing plates in position.

It has been proposed heretofore to utilize vacuum means to retain the printing plates in position on the printing cylinders. Representative of prior proposals for this purpose are the Kamata, et al. U.S. Pat. No. 3,078,796 the Lake U.S. Pat. No. 3,112,698, the Musgrave U.S. Pat. No. 3,380,381, the Demaria, et al. U.S. Pat. No. 3,463,476 and the Johnson British Pat. No. 484,169. The theoretical advantages of the vacuum cylinder are evident, in that it is expected to be able to more easily mount printing plates thereon. Changing of printing plates is also expected to be facilitated. However, notwithstanding the expected advantages to be derived from the vacuum cylinder, its commercial acceptance has been extremely limited, because of the practical difficulties experienced in achieving an effective design of a vacuum cylinder suitable for use under conditions of day-to-day commercial production.

A greatly improved design and construction of a vacuum-operated printing cylinder suitable for utilization under conditions of typical commercial production has been proposed in copending Arkell application Ser. No. 504,254, filed Sept. 9, 1974 and owned by Livermore and Knight Co., Inc. In its various forms, the Arkell invention provides a highly effective and entirely practical printing cylinder capable of holding a printing plate by vacuum alone, without requiring auxiliary holding means. According to its teachings, vacuum power is effectively distributed to the cylinder surface by means of independently evacuable chambers within the cylinder. The separate chambers communicate with the cylinder surface via an effective arrangement of flow passages through the cylinder sleeve opening directly to the cylinder surface or to a series of annular grooves formed thereon. The utilization of independently evacuable chamber permits the application of vacuum holding power to areas of the printing cylinder actually covered by the printing plate with a minimum of leakage. This will accommodate the use of plates of varying sizes, as well as multiple plates on a side-by-side basis. In the latter case, some of the plates can be removed and replaced without affecting the other plates by maintaining the vacuum in certain chambers, while removing it from others.

As one of its basic objectives, the present invention seeks to provide a novel and improved, commercially acceptable vacuum-operated printing cylinder of the general type proposed in the co-pending Arkell application and which provides an instantaneous initial hold for the plates and facilitate a much shorter plate mounting time. Generally, the new vacuum-operated printing cylinder comprises an elongated supporting shaft extending from one end of the cylinder to the other end sufficiently beyond to provide bearing support. A hollow cylinder sleeve is secured to the supporting shaft by means of a plurality of cylinder supporting rings secured in axially spaced relation on the supporting shaft forming therewith one or more vacuum chambers within the printing cylinder.

As a unique feature of the present invention, the supporting shaft is formed to provide a pre-evacuation chamber. Several independently controlled valve means are built into the cylinder to provide vacuum communication between each individual vacuum chamber of the hollow cylinder and the pre-evacuation chamber. Vacuum communication between the vacuum chambers and the exterior surface of the printing cylinder is achieved by means of radial passages in the cylinder sleeve. The end of the pre-evacuation chamber is connected to piping which passes through the supporting shaft to a vacuum source.

The new and improved construction disclosed herein affords a highly advantageous means to apply effective vacuum holding power to the cylinder surface. The pre-evacaution chamber can be kept evacuated. When it it desired to attach a printing plate to the cylinder, the vacuum power of the pre-evacuation chamber will be available to be immediately applied to the exterior surface of the printing cylinder by operating the appropriate valve means. The result is a virtually instantaneous hold on the plate, freeing the operator to perform other tasks. Moreover, since the pre-evacuation chamber partially evacuates the vacuum chambers the time required to build up to a running hold to retain the plate on the cylinder during operation of the printing press will be greatly diminished.

Consequently, the inventive concept of a pre-evacuation chamber greatly enhances the overall efficacy of a vacuum-operated printing cylinder. Moreover, by forming a cylindrical pre-evacuation chamber within the supporting shaft itself, the pre-evacuation chamber provides a good structural component for the printing cylinder and affords easy construction.

In accordance with another form of the present invention, vacuum communication between the pre-evacuation chamber and the outer surface of the printing cylinder can be achieved to provide an effective balance with respect to the amount and distribution of exposed vacuum area. Adequately distributed vacuum holding power can be made available to secure the printing plates, while at the same time minimizing leakage, which would reduce the overall holding effectiveness of the cylinder.

More particularly, the printing cylinder surface is provided with a plurality of continuous annular grooves. The annular grooves are interrupted by longitudinally extending grooves, continuous from one end of the cylinder to the other. A soft metal strip is then tightly received in the longitudinal grooves to effectively block off the annular grooves and provide a predetermined circumferential discontinuity between adjacent ends of each groove. Preferably, four longitudinal grooves are cut into the cylinder sleeve to divide the cylinder surface into four circumferential regions.

Each discontinuous annular groove communicates with a radial passage in the cylinder sleeve. The radial passages are arranged so that all the radial passages of a predetermined longitudinal section of the printing cylinder communicate with one of a plurality of axial bores formed in the cylinder sleeve. Each axial bore is provided with manually accessible valve means for selective vacuum communication with the pre-evacuation chamber.

To particular advantage, this arrangement allows the vacuum power from the pre-evacuation chamber to be immediately, selectively applied to a large number of predetermined cylinder surface areas. If, for example, four longitudinal grooves are provided and four axial bores are provided for each of the four sets of discontinuous annular grooves formed thereby, the printing cylinder surface will be divided into sixteen predetermined areas. Consequently, if a small printing plate is to be attached to the cylinder all the vacuum power can be directed to the area covered by the plate. The otherwise exposed areas of the cylinder surface will be isolated from the pre-evacuation chamber by the action of the independent valve means to minimize leakage.

For a better understanding of the above and other features and advantages of the invention, reference should be made to the following detailed description and accompanying drawings.

DETAILED DESCRIPTION OF PREFERRED EMBODIMENTS OF THE INVENTION

Figure 1:
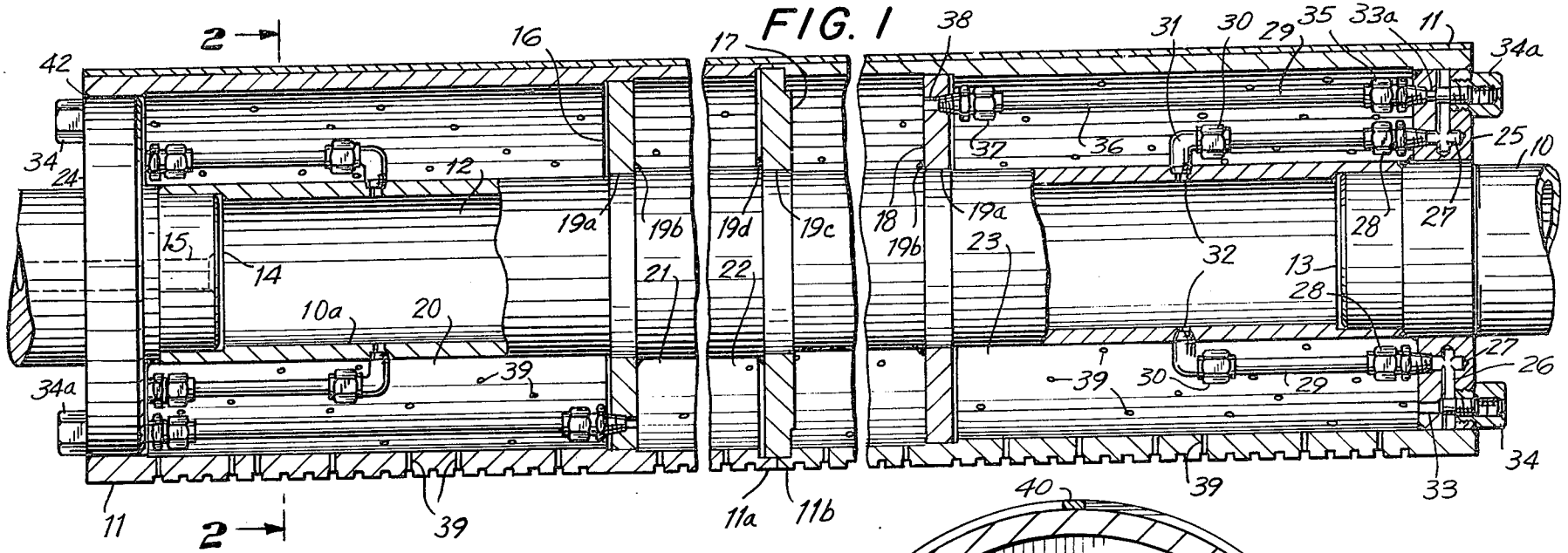
FIG. 1 is a longitudinal cross sectional view of a vacuum-operated printing cylinder incorporating features of the present invention.
Figure 2:
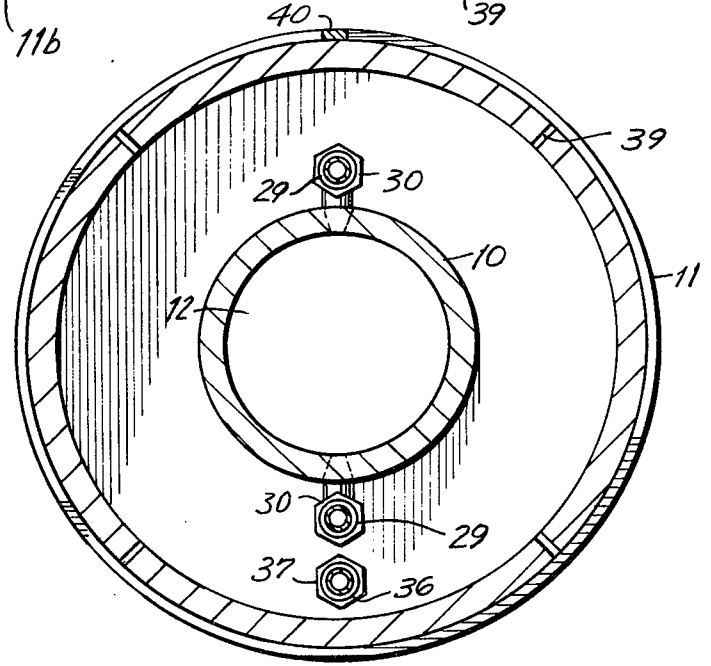
FIG. 2 is a cross sectional view taken generally along line 2—2 of FIG. 1.

Referring now to the drawings, and initially to FIGS. 1 and 2, the reference numeral 10 designates generally an elongated shaft assembly of a length suitable to extend through the entire length of a cylinder sleeve 11. The shaft assembly 10 extends sufficiently beyond the cylinder sleeve 11 to provide bearing supports (not shown) by means of which the shaft 10 is supported in a printing press (not shown) in a conventional and well known manner.

As a unique feature of the present invention, the shaft 10 includes a tubular central section 10a arranged to provide a pre-evacuation chamber 12. A pair of bearing shaft sections 13, 14 are securely mounted within the ends of the tubular shaft section **10*a* to close off the ends of the pre-evacuation chamber 12. An evacuation passage 15 runs internally of the shaft 10 from one end thereof to the bearing section 14 and communicates with the pre-evacuation chamber 12. The outer end of the passage 15** is arranged to be connected by an appropriate rotary coupling (not shown) to a vacuum pump.

In the first illustrated form of the invention, the shaft 10 is formed to have a stepped construction, reflected at **19*a–d*, so that its outer diameter increases in the areas spaced from either end of the shaft 10. A plurality of supporting rings 16–18 are axially applied over the shaft 10 from the ends thereof. The ring 17 is applied from the right end of the shaft over steps 19*a, b* to be rightly received over step 19*c* and seated against the next step 19*d*. The rings 16, 18 are then applied from the left end and right end respectively and are tightly received over the first step 19*a* and seated against the next step 19*b*. The supporting rings 16–18 can be secured to the shaft 10 by welding. The supporting rings 16–18 are arranged so that the outer diameter of supporting ring 17 is larger than the outer diameters of the supporting rings 16, 18.**

In assembling the cylinder, the cylinder sleeve 11 is constructed in two half sections **11*a*, 11*b*. The two sections 11*a*, 11b are axially received over the shaft 10 from the left and right ends of the shaft 10 respectively and meet at the center supporting ring 17. The supporting rings 16–18 divide the annular region between the cylinder sleeve 11 and shaft 10 into separate vacuum chambers 20–23.**

Extending between the cylinder sleeve 11 and the shaft 10 are a pair of end plates 24, 25 which can be welded to the sleeve 11 and shaft 10, as reflected at 42. Each end plate 24, 25 is provided with a pair of independently valved passages to facilitate selective vacuum communication between each of the separate vacuum chambers 20–23 and the pre-evacuation chamber 12. The construction of each end plate 24, 25 is identical and for convenience the detailed description will be made with reference to the end plate 25.

As reflected in FIG. 1, the end plate 25 is provided with a pair of dead ended radially disposed bores 26. Blind transverse bores 27 communicate with bores 26 and open to the vacuum chamber 23 adjacent the end plate 25. The open end of each bore 27 is enlarged and threaded to receive a union fitting 28 within the vacuum chamber 23. The union fittings 28 are each connected to a section of tubing 29 running internally of vacuum chamber 23 to a union fitting 30.

An elbow shaped connector 31 is connected to each union fitting 30 and is received in a bore 32 cut through shaft 10 to the pre-evacuation chamber 12. A pair of transverse bores 33, 33a extend through the end plate 25 and communicate with one of the bores 26 respectively at a point spaced from blind bore 27.

To provide selective vacuum communication between the chamber 23 and the pre-evacuation chamber 12, the left hand side or internal opening of the transverse bore 33 communicates directly with the chamber 23. The right hand side or outer opening of transverse bore 33 is enlarged and threaded to receive a valve plug 34 whereby vacuum communication between the chamber 23 and the bore 26 can be established and interrupted.

Selective vacuum communication between the vacuum chamber 22 and pre-evacuation chamber 12 can be achieved in a similar manner. The left-hand side or internal opening of transverse bore 33a is enlarged and threaded to receive a union fitting 35. A section of tubing 36 is connected to the union fitting 35 and runs internally of the vacuum chamber 23 to a union fitting 37. The union fitting 37 is received in a bored passage 38 cut through the support ring 18 which separates chambers 22 from chamber 23. The right hand side or outer opening of transverse bore 33a is enlarged and threaded to receive a valve plug 34a.

As was discussed above, selective vacuum communication between the chambers 20, 21 and pre-evacuation chamber 12 is achieved by an identical arrangement of valve plugs, bored passages and tubing in the end plate 24 and vacuum chamber 20. In this manner each vacuum chamber 20–23 selectively communicates with the pre-evacuation chamber via the combination of bored passages and tubing.

To provide vacuum communication between the vacuum chambers 20–23 and the exterior surface of cylinder sleeve 11, a plurality of appropriately distributed radial bores 39 are formed in the sleeve 11. At a selected point on the cylinder surface, an axially disposed locating line 40 is scribed to assist in lining up the ends of a printing plate.

Though specific dimensions are not deemed critical to the present invention, a typical printing cylinder incorporating the features of the invention may have a pre-evacuation chamber 12 with a diameter approximately half the internal diameter of the cylinder sleeve 11. As a result, the pre-evacuation chamber 12 will have a volume approximately one-fourth the total volume of the cylinder. Accordingly, when the pre-evacuation chamber is evacuated it will develope vacuum holding power sufficient to partially evacuate the chambers 20–23. Moreover, the vacuum power will be immediately available for application to the vacuum chambers 20–23. This will provide an initial holding force to instantaneously mount a plate and greatly reduce the time required to fully evacuate the printing cylinder to effectively hold the plate during operation of the press.

In the operation of the cylinder assembly of FIGS. 1-2, the pre-evacuation chamber 12 is evacuated by means of vacuum pump connected to the evacuation pipe 15. In a typical case, a flexible printing plate will be cut to a suitable size to nearly cover the entire operating surface of the cylinder in the circumferential direction. The plate would extend from scribbed line 40 around the cylinder to a point as close as possible to scribed line 40. To apply the vacuum holding power of the pre-evacuation chamber 12 to the cylinder surface one or more of the valve plugs 34, 34a in the end plates 24, 25 are opened to provide selective communication between the vacuum chambers 20–23 and the pre-evacuation chamber 12.

To particular advantage, the vacuum holding power of the pre-evacuation chamber 12 will be immediately applied to partially evacuate the separate chambers 20–23 and hold a printing plate. In prior proposals of vacuum-operated printing cylinders distributed to the cylinder surface was achieved by direct communication with the external vacuum system pump. The present invention allows vacuum power to build up in the pre-evacuation chamber 12 prior to a printing plate change. When it is desired to mount a new plate, the reserve vacuum power of the chamber 12 is immediately available to provide initial holding of the printing plate. Full vacuum holding power is achieved by continued evacuation by the external vacuum pump system via the pre-evacuation chamber 12. The result is a highly effective cylinder assembly affording means for a speedy and simple plate changing operation. Where appropriate, the printing cylinder may be activated or de-activated incrementally, by means of the valve plugs **34, 34*a*** to accommodate printing plates of varying sizes in the longitudinal direction.

Figure 3:
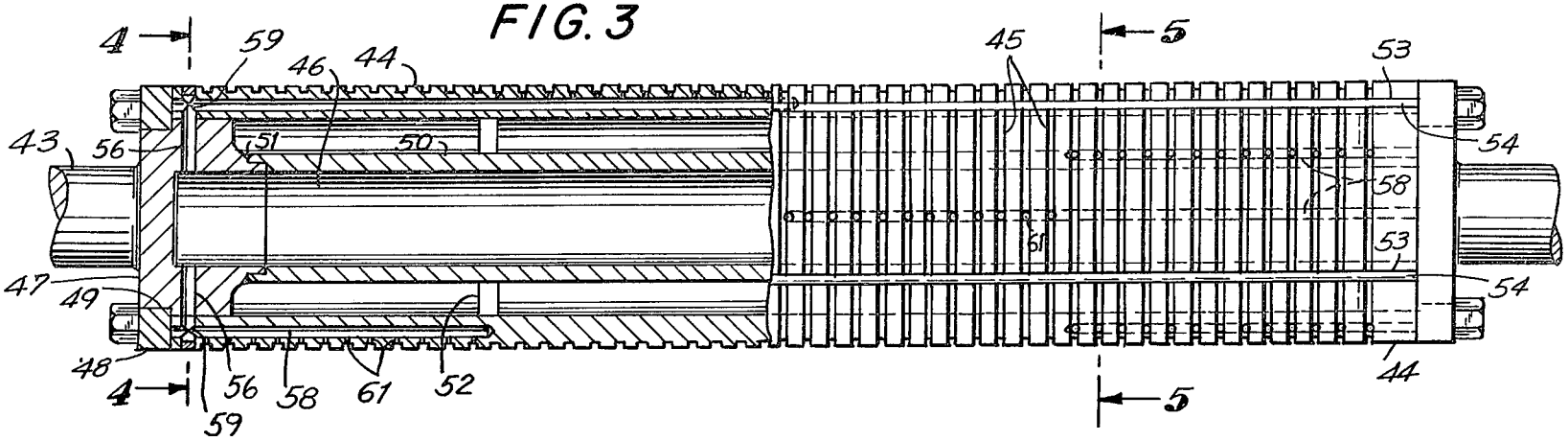
FIG. 3 is a partially sectioned elevational view of another embodiment of the present invention.
Figure 5:
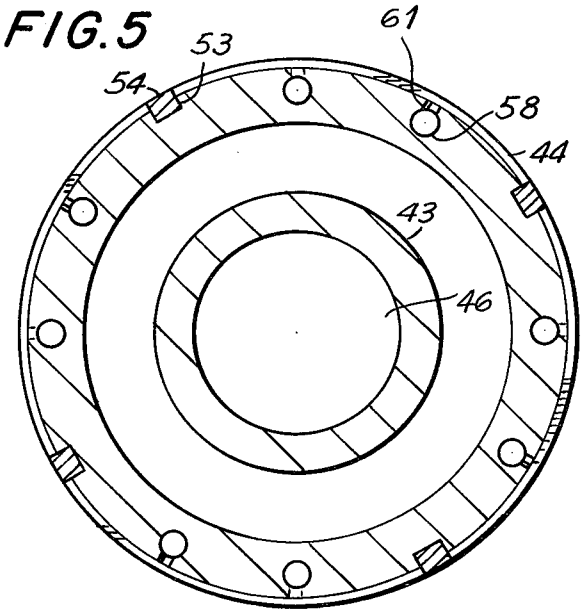
FIG. 5 is a cross sectional view taken generally along line 5—5 of FIG. 3.
Figure 4:
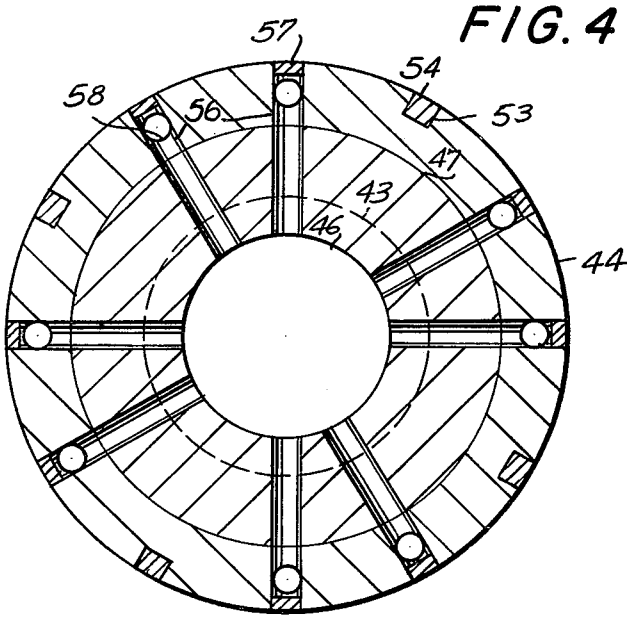
FIG. 4 is a cross sectional view taken generally along line 4—4 of FIG. 3.

In another form of the invention, illustrated in FIGS. 3–5, vacuum communication between the pre-evacuation chamber 46 and the cylinder surface is provided by means to distribute the vacuum power to predetermined sections of the cylinder surface. A shaft assembly 43 extends through the entire length of the cylinder sleeve 44 and sufficiently beyond to provide bearing support (not shown) as described above. The construction of the printing cylinder is identical at both ends thereof and for convenience the left hand side only will be described in detail below.

A bearing shaft section 47 extends between the shaft assembly 43 and cylinder sleeve 44. An end bearer ring 48 is received into a grooved section 49 of the bearing shaft section 47 to firmly secure the cylinder sleeve 44. A tubular central section 50 is connected to the bearing shaft section 47 and extends between points adjacent but spaced inwardly from the ends of the cylinder sleeve 44. The tubular central section 50 may be welded to the bearing section 47, as reflected at 51, and is provided with a plurality of axially spaced aupport rings 52 to support the cylinder sleeve 44.

The cylinder sleeve 44 is provided with a series of continuous annular grooves 45 spaced across the entire working length of the sleeve 44. To advantage, a set of axially extending grooves 53 are provided in the cylinder sleeve 44 to interrupt the annular grooves 45. Ideally, four axially grooves 53 are provided, spaced approximately 90° apart to divide the cylinder surface into four circumferentially extending regions.

Received in the axial grooves 53 are soft metal strips 54 which extend the entire length of the cylinder sleeve 44 and form a continuation of the printing cylinder surface. The soft metal strips 54 are sufficiently, tightly received in the grooves 53 to seal off the end areas 55 of the annular grooves 45 so that the grooves 45 are divided into circumferentially discontinuous segments with each segment extending effectively over approximately 90° of the cylinder surface.

A set of radially disposed bores 56 are formed through the cylinder sleeve 44, bearing shaft section 47 and shaft 43 to the pre-evacuation chamber 46. The ends of the bores 56 opening to the cylinder surface are sealed off by plugs 57 which are tightly received therein. Each bore 56 communicates with an axially extending blind bore 58 formed in the cylinder sleeve 44 from the outer ends thereof.

In accordance with the invention, a valve 59 is received in each blind bore 58 at the point where the blind bore 58 communicates with the radial bore 56 to provide selective vacuum communication with the pre-evacuation chamber 46.

As reflected in FIG. 3, each discontinuous segment of each of the annular grooves 45 communicates with one of the blind bores 58 by means of a radial bore 61 formed in the cylinder sleeve 44. The blind bores 58 are arranged so that they communicate with all the radial bores 61 opening to the discontinuous annular grooves 45 within a predetermined longitudinal section of the cylinder sleeve 44. In this manner, the vacuum holding power of the pre-evacuation chamber 46 may be selectively applied to several predetermined areas of the printing cylinder surface by operating valves 59.

While the scope of the invention is not limited by the exact number of axial grooves 53 or blind bores 58, the embodiment illustrated in FIGS. 3–5 is provided with four axial grooves 53 and four blind bores 58 for each circumferential section formed by the grooves 53, two such bores 58 extending from either end of the cylinder sleeve 44. This arrangement will divide the printing cylinder surface into sixteen predetermined areas.

In the operation of the printing cylinder, flexible printing plates of various dimensions can be placed on the cylinder surface. The vacuum holding power of the pre-evacuation chamber 38 can be immediately applied to the areas of the cylinder surface covered by the plate by opening the appropriate valves 59. The otherwise exposed areas will be isolated from the pre-evacuation chamber 46 by the closed condition of the remaining valves 59.

In its various forms, the present invention provides an entirely practical means for utilization of vacuum to hold printing plates on a rotary cylinder. This not only expedites a printing plate change operation, but also improves printing quality by minimizing surface discontinuities. The strategic placement of the novel pre-evacuation chamber in the supporting shaft itself affords a simple, easily constructed structural component for the cylinder. Moreover, the reserve vacuum power of the pre-evacuation chamber greatly improves the operation of the cylinder by providing an instantaneous initial hold for the plate. This relieves the operator of the task of holding the plate while the vacuum holding power builds up. Furthermore, since the pre-evacuation partially evacuates the vacuum chamber, the time necessary to fully evacuate the cylinder for running operation is somewhat improved. The inventive concept illustrated herein provides a printing cylinder which enables the theoretical advantages of vacuum holding means to be realized in practice and provides a speedy and highly efficient operation.

While the particular printing cylinders described herein are representative embodiments of this invention, the invention is not limited to these particular arrangements and, as will be appreciated and understood by those skilled in the art, changes may be made therein without departing from the scope of the invention which is defined in the appended claims.

I claim:

1. A vacuum-operated printing cylinder, which comprises a. a shaft, b. a cylinder sleeve surrounding and supported on said shaft to form a cylindrical structure wherein the annular region between said shaft and said cylinder sleeve forms a vacuum chamber, c. a pre-evacuation chamber internal of said cylindrical structure, d. first air passage means connected to said pre-evacuation chamber for application of vacuum thereto, e. valved air passage means interconnecting said vacuum chamber and said internal pre-evacuation chamber, f. a valve operator located externally of said printing cylinder and associated with said valved air passage means for selectively controlling the valved air passage means, whereby said vacuum chamber is isolated from said internal pre-evacuation chamber and the vacuum effect of the pre-evacuation chamber may be immediately applied to said vacuum chamber by the selective operation of said valved air passage means, and g. second air passage means providing vacuum communication between said vacuum chamber and the exterior of said cylinder sleeve.

2. The vacuum-operated printing cylinder according to claim 1, further characterized by a. said pre-evacuation chamber comprising a hollow cylindrical cavity formed in said shaft.

3. The vacuum-operated printing cylinder according to claim 2, further characterized by a. the volume of said cavity being approximately one-fourth or more of the total volume of the vacuum cylinder whereby the vacuum power of the pre-evacuation chamber is sufficient to partially evacuate said vacuum chamber to provide an initial hold for a printing plate.

4. A vacuum-operated printing cylinder, which comprises a. a shaft provided with a pre-evacuation chamber, b. air passage means connected to said pre-evacuation chamber for application of vacuum thereto, c. a cylinder sleeve surrounding and supported on said shaft, d. means internal of said sleeve subdividing the annular region between said shaft and said sleeve into one or more vacuum chambers, e. selectively operable, independently valved air passage means interconnecting each of said chambers to said internal pre-evacuation chamber to provide selective vacuum communication between each of said chambers and said pre-evacuation chamber, whereby the vacuum of said pre-evacuation chamber will be available to be immediately applied to each of said vacuum chambers by the selective operation of the appropriate independently valved air passage means, f. valve operator means located externally of said printing cylinder and associated with said independently valved air passage means, and g. air passage means providing vacuum communication between each of said chambers and the exterior of said cylinder sleeve.

5. The vacuum-operated printing cylinder according to claim 4, further characterized by a. said subdividing means comprising a plurality of support rings mounted on said shaft in an axially spaced relation.

6. A vacuum-operated printing cylinder, which comprises a. a shaft b. a cylinder sleeve surrounding and supported on said shaft to form a cylinder structure, c. a pre-evacuation chamber internal of said cylinder structure, d. air passage means connected to said internal pre-evacuation chamber for application of vacuum thereto, e. a plurality of circumferentially discontinuous annular grooves formed in the outer surface of said cylinder sleeve, f. a plurality of selectively operable independently valved air passage means for selective vacuum communication between said internal pre-evacuation chamber and the discontinuous annular grooves within predetermined longitudinal sections of said cylinder sleeve, and g. a plurality of valve operators located externally of said printing cylinder and associated with said valved air passage means, whereby the vacuum effect of said internal pre-evacuation chamber may be selectively, immediately applied to said annular grooves.

7. The vacuum-operated printing cylinder according to claim 6, further characterized by a. said pre-evacuation chamber being internal of said shaft.

8. A vacuum-operated printing cylinder, which comprises a. a shaft, b. a cylinder sleeve surrounding and supported on said shaft to form a cylindrical structure wherein the annular region between said shaft and said cylinder sleeve forms a vacuum chamber, c. a pre-evacuation chamber internal of said cylindrical structure, d. said printing cylinder provided with end plates extending between said shaft and said sleeve, e. air passage means connected to said internal pre-evacuation chamber for application of vacuum thereto, f. one of said end plates including air passage means provided with an inlet portion and an outlet portion, each of said portions opening internally of said cylinder, g. said inlet portion communicating with passage forming means running internally of said cylinder to said pre-evacuation chamber, h. said outlet portion communicating directly with said vacuum chamber, i. externally accessible valve means connected to said air passage means whereby said vacuum chamber selectively communicates with said pre-evacuation chamber, and air passage means providing vacuum communication between said vacuum chamber and the exterior of said cylinder sleeve.

9. A vacuum-operated printing cylinder, which comprises a. a shaft provided with a pre-evacuation chamber, b. air passage means connected to said pre-evacuation chamber for application of vacuum, thereto, c. a cylinder sleeve surrounding and supported on said shaft, d. means internal of said sleeve subdividing the annular region between said shaft and said sleeve into one or more vacuum chambers, e. said printing cylinder provided with end plates extending between said shaft and said sleeve, each of said end plates including first and second air passage means, f. said air passage means each provided with an inlet portion and an outlet portion, each of said portions opening internally of said cylinder, g. said inlet portion of each air passage means communicating with passage forming means running internally of said cylinder to said pre-evacuation chamber, h. the outlet portion of said first air passage means communicating with said vacuum chamber formed adjacent said end plate by said subdividing means, i. the outlet portion of said second air passage means communicating with passage forming means running internally of said cylinder to the vacuum chamber formed spaced from said end plate by said subdividing means, j. externally accessible valve means connected to each of said air passage means whereby each vacuum chamber selectively communicates with said internal pre-evacuation chamber, and k. air passage means providing vacuum communication between said chambers and the exterior of said cylinder sleeve.

10. The vacuum-operated printing cylinder according to claim 9, further characterized by a. said air passage means comprising bored passages formed in said end plates.

11. The vacuum-operated cylinder of claim 9, further characterized by a. said exterior air passage means comprising a plurality of radial bores formed in said sleeve.

12. A vacuum-operated printing cylinder which comprises a. a shaft, b. a cylinder sleeve surrounding and supported on said shaft to form a cylinder structure, c. a pre-evacuation chamber internal of said cylinder structure, d. air passage means connected to said pre-evacuation chamber for application of vacuum thereto, e. a plurality of circumferentially discontinuous annular grooves formed in the outer surface of said cylinder sleeve, f. said printing cylinder provided with a pair of end plates extending between said shaft and said sleeve at the ends of said sleeve, g. a plurality of radially disposed air passage means formed through said sleeve, end plate and shaft and communicating with said pre-evacuation chamber, h. a plurality of axially extending air passage means formed in said sleeve, each of said axial air passage means communicating with one of said radial air passage means, i. said axial air passage means communicating with a set of radial bores formed in said sleeve and opening to the discontinuous annular grooves within a predetermined longitudinal section of said cylinder, and j. externally accessible valve means interconnecting said axial air passage means and said radial air passage means to provide selective vacuum communication between said internal pre-evacuation chamber and the discontinuous annular grooves within a predetermined longitudinal section of said cylinder.

* * * * *